United States Patent [19]

Ihringer

[11] 4,407,316

[45] Oct. 4, 1983

[54] CLEANING INSTALLATION

[76] Inventor: Ernest Ihringer, Chemin du Liaudoz, 9 CH-1009 Pully, Switzerland

[21] Appl. No.: 294,564

[22] Filed: Aug. 20, 1981

[30] Foreign Application Priority Data

Aug. 21, 1980 [CH] Switzerland ..... 6307/80

[51] Int. Cl.[3] ..... B08B 3/02

[52] U.S. Cl. ..... 134/104; 134/107

[58] Field of Search ..... 134/104–105, 134/107–108

[56] References Cited

U.S. PATENT DOCUMENTS 1,451,981 4/1923 Heller ..... 134/104

1,608,635 11/1926 Theriot ..... 134/104 X 2,471,506 5/1949 Wiswall ..... 134/104 X 4,168,714 9/1979 Bahrke ..... 134/104 X

*Primary Examiner*—Robert L. Bleutge

*Attorney, Agent, or Firm*—Emory L. Groff, Jr.

[57] ABSTRACT

Installation for cleaning painted parts comprising a treatment chamber (1) in which the painted parts to be cleaned are exposed to jets of hot water-miscible, cleaning solvent. The installation also includes separating means (7, 8, 14, 18) for the light paint solvents, the cleaning solvent of the paint, the water cleaning solvent, and the gas cleaning solvent, with a view to recycling the cleaning solvent.

6 Claims, 1 Drawing Figure

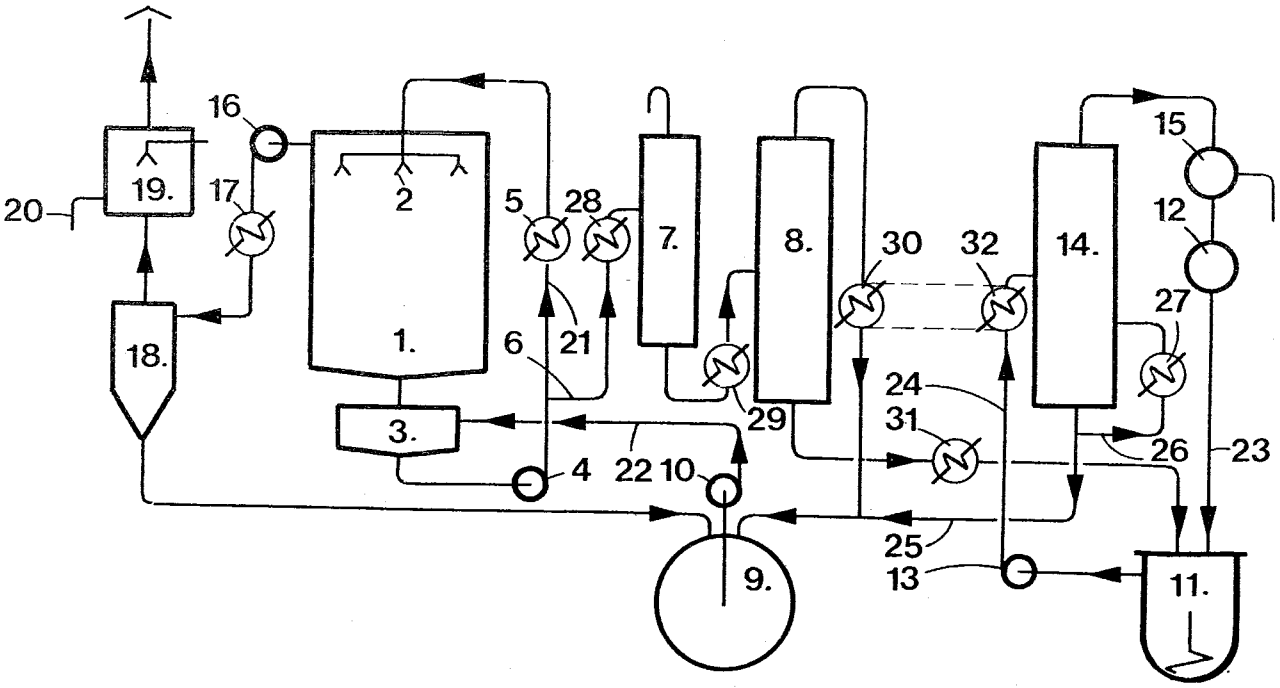
1.
2
3.
4
5
6
7.
8.
9.
10
11.
12
13
14.
15
16
17
18.
19.
20
21
22
23
24
25
26
27
28
29
30
31
32

CLEANING INSTALLATION

The present invention relates to a cleaning installation, utilising a water-miscible organic solvent having a boiling point higher than that of water, for parts of machines and of pieces of all types which have been exposed to jets of paint.

It is known that pyrrolidone and its derivatives are water miscible and constitute industrial solvents of high boiling point.

It has been found that 2-N-methyl-pyrrolidone presents particularly interesting qualities for the cleaning of sheet metal and various machine parts which have been exposed to jets of paint especially in paint tunnels. Thus, the grills and transporting members of such tunnels must be cleaned from time to time. Sheet metal body parts defectively painted can be salvaged and repainted after cleaning.

So as to permit the industrial cleaning of such materials, the installation in accordance with the invention is characterised in that it comprises a treatment chamber operable under reduced pressure in which the parts and pieces to be cleaned are exposed to jets of hot solvent, the said chamber being directly or indirectly connected to devices for recovering and for recycling the solvent.

The present invention is illustrated, by way of example, with reference to the accompanying drawing, in which the single FIGURE of the drawing is a diagrammatic view of a cleaning installation in accordance with the invention.

As illustrated, the installation comprises a water-tight cleaning chamber 1, provided interiorly with full jet, non-pulverising nozzles 2, said nozzles 2 being connected by a conduit 21 to a cleaning solvent receptacle 3, the conduit 21 being provided with a pump 4 and a heating exchanger 5. The conduit 21 is also provided with a branch conduit 6 leading towards fractional distillation columns 7 and 8 which are connected in series.

A centrifugal ventilator 16 is mounted in the gas outlet conduit from the chamber 1, which ventilator 16 is connected to a cyclone 18 via a refrigerating heat exchanger 17. A water washing tower 19 is mounted above and connected to the cyclone 18. The base of the cyclone 18 and the top of the column 8 are both independently connected to a cleaning solvent reservoir 9 which reservoir in turn is connected to the cleaning solvent receptacle 3 by a conduit 22 provided with a pump 10.

The washing tower 19 is connected by a conduit 20 to a third fractional distillation column 14, which column 14 is connected on the other hand to a mixer 11 by a conduit 24 equipped with a pump 13.

The base of the column 14 is connected to the cleaning solvent reservoir 9 by a conduit 25. The conduit 25 is provided with a branch conduit 26 passing through a heat exchanger 27 before returning to the column 14. The top of the column 14 is connected to the mixer 11 by a conduit 23 successively passing through a decanting reservoir 15 and a water stock reservoir 12.

The installation functions as follows:

2-N-methyl-pyrrolidone is pumped from the receptacle 3 by the pump 4 and passes into the heat exchanger 5 and is directed in large jets by the nozzles 2 onto the materials to be cleaned which have been introduced into the chamber 1 by a transporting device not shown. To avoid gas leaks to the exterior, the chamber 1 is maintained under a reduced pressure of the order of 3 to 4 water column. The cleaning solvent, 2-N-methyl-pyrrolidone, which returns to the receptacle 3 is repumped towards the nozzles 2 as previously described.

A branch conduit 6 in the feed conduit 21 for the nozzles 2, directs a part of the cleaning solvent charged with paint via a heating heat exchanger 28 on to the fractional distillation column 7, at the top of which the greater part of the light solvents of the paint escape. The cleaning solvent charged with paint flows away from the base of the column 7 via a heating heat exchanger 29 into the evaporation column 8 at the top of which cleaning solvent escapes and is condensed in a refrigerating heat exchanger 30 and directed towards the reservoir 9, while the paint still containing cleaning solvent is directed from the base of the column 8, via a refrigerating heat exchanger 31, towards the mixer 11, and is mixed with water coming from the water reservoir 12.

The paint is deposited in the bottom of the mixer 11 and the cleaning solvent dissolved in the water which floats on the surface is pumped by the pump 13 via a heating heat exchanger 32 to the fractional distillation column 14. The water escapes in the form of steam from the top of the column 14 and entrains the rest of the light solvents of the paint not water miscible which is decanted in the reservoir 15, while the rest of the cleaning solvent is directed to the base of the column 14 towards the reservoir 9 to be repumped towards the receptacle 3. The paint at the bottom of the mixer 11 is removed.

Numerous variations of the installation described and represented in the drawing can be envisaged. In small installations, one can, for example, omit the mixer 11 and the fractional distillation column 14 and simply collect any existing material from the bottom of the column 8 in a drum. Subsequently the drum is placed in an airtight container. The cleaning solvent retained in the paint is extracted and recycled in the installation by heating and put under vacuum in the container. The drum containing the paint is subsequently disposed of.

I claim:

1. Installation for cleaning parts of machines and pieces of all types which have been exposed to jets of paint by means of a water-miscible organic solvent having a boiling point higher than that of water, comprising a treatment chamber operating under reduced pressure, in which said parts and pieces to be cleaned are exposed to jets of hot solvent, said chamber being directly or indirectly connected to devices for recovering and for recycling said solvent, a ventilator mounted on a gas outlet conduit from said treatment chamber, said ventilator connected to a cyclone by means of a refrigerating heat exchanger.

2. Installation as claimed in claim 1, in which said treatment chamber is equipped with non-pulverising nozzles connected by a conduit to a cleaning solvent receptacle disposed below said chamber and communicating therewith, said conduit being provided with a pump and a heat exchanger ensuring the heating of the solvent.

3. Installation as claimed in claim 2, in which said conduit is provided with a branch conduit for directing a part of the solvent to a first fractional distillation column for separating light solvents from the paint.

4. Installation as claimed in claim 3, in which the base of said first column is connected to a second fractional distillation column for the separation of the cleaning solvent from the paint.

5. Installation as claimed in claim 4, in which the top of said second column and the base of the cyclone are connected by conduits to a cleaning solvent reservoir which is connected, in turn, by a conduit provided with a pump to said receptacle disposed below said chamber.

6. Installation as claimed in claim 5, in which the base of the second column is connected to a mixer, a conduit provided with a pump connecting the upper part of the mixer with a third fractional distillation column the base of which is connected to said reservoir by a conduit, said conduit provided with a branch conduit having a heat exchanger to ensure evaporation of the water mixed with the cleaning solvent.

* * * * *